United States Patent [19]

Erb

[11] Patent Number: 4,615,084

[45] Date of Patent: Oct. 7, 1986

[54] MULTIPLE HOOK FASTENER MEDIA AND METHOD AND SYSTEM FOR MAKING

[75] Inventor: George H. Erb, Cuttingsville, Vt.

[73] Assignee: Erblok Associates, Charlottesville, Va.

[21] Appl. No.: 643,001

[22] Filed: Aug. 21, 1984

[51] Int. Cl.[4] ..... A44B 18/00

[52] U.S. Cl. ..... 24/442; 24/306; 156/66; 264/296; 428/93; 428/100; 428/369

[58] Field of Search ..... 24/306, 442, 445; 156/66; 264/235, 296; 428/93, 100, 369

[56] References Cited

U.S. PATENT DOCUMENTS

| | | | |
|---|---|---|---|
| 3,147,528 | 9/1964 | Erb . | |
| 3,196,490 | 7/1965 | Erb . | |
| 3,527,629 | 9/1970 | Wylde | 428/93 X |
| 3,546,754 | 12/1970 | Erb . | |
| 3,550,223 | 12/1970 | Erb . | |
| 3,550,837 | 12/1970 | Erb | 229/45 R |
| 3,562,044 | 2/1971 | Erb | 156/155 |
| 3,562,770 | 2/1971 | Erb . | |
| 3,586,060 | 6/1971 | Erb | 139/46 |
| 3,594,863 | 7/1971 | Erb . | |
| 3,594,865 | 7/1971 | Erb . | |
| 3,595,059 | 7/1971 | Erb | 72/362 |
| 3,629,032 | 12/1971 | Erb | 156/196 |
| 3,665,584 | 5/1972 | Erb | 29/410 |
| 3,695,976 | 10/1972 | Erb | 156/435 |
| 3,708,382 | 1/1973 | Erb . | |
| 3,715,415 | 2/1973 | Erb | 204/25 |
| 3,732,604 | 5/1973 | Erb . | |
| 3,735,468 | 5/1973 | Erb . | |
| 3,781,398 | 12/1973 | Erb | 264/146 |
| 3,801,245 | 4/1974 | Erb | 425/174.4 |
| 4,169,303 | 10/1979 | Lemelson | 428/100 X |
| 4,376,152 | 3/1983 | Bennett | 428/100 X |

*Primary Examiner*—Robert A. Dawson

*Attorney, Agent, or Firm*—Parmelee, Bollinger & Bramblett

[57] ABSTRACT

Multiple hook-fastener media in which many protruding hooks are formed at relatively high speed from suitable bendable and settable plastic material which may be different from the substrate to which these pre-formed hooks are subsequently bonded. Many rows of hooks are formed simultaneously, each row from a strand, for example, a monofilament of longitudinally oriented polymeric material. The formed strands are "set" into their multiple hook row configuration, and then these pre-formed rows of hooks are simultaneously bonded to the substrate. Thus, an attractive substrate of any reasonable width, for example, of three inches, six inches, a foot or a yard, may be used. The production method and system enable the number of hooks per square inch, either longitudinally or laterally or both, to be adjusted while running. The shank of each hook includes two legs, and the production method and machine can be adjusted while running for making hooks with crossed legs, uncrossed legs or divergent legs for achieving varieties of configurations and characteristics, as desired for various applications. Advantageously, the production can be changed for making taller or shorter hooks and for making hooks with differently shaped arcuate ends by exchanging one pair of meshing (interdigitating) shaping belts for another. The substrate material may be woven or unwoven and may comprise multiple layers including metal or plastic layers or both. The substrate with mounted hooks can be slit longitudinally for producing many hook-fastener tapes at relatively fast overall lineal speed. Consequently, the hook-fastener media of this invention with their various sizes, shapes, widths and characteristics, fabricated by relatively low-cost, high-speed production hold promise of becoming widely available, widely used, commodity-type products which will find their way into myriads of applications of benefit to human beings in years to come.

42 Claims, 12 Drawing Figures

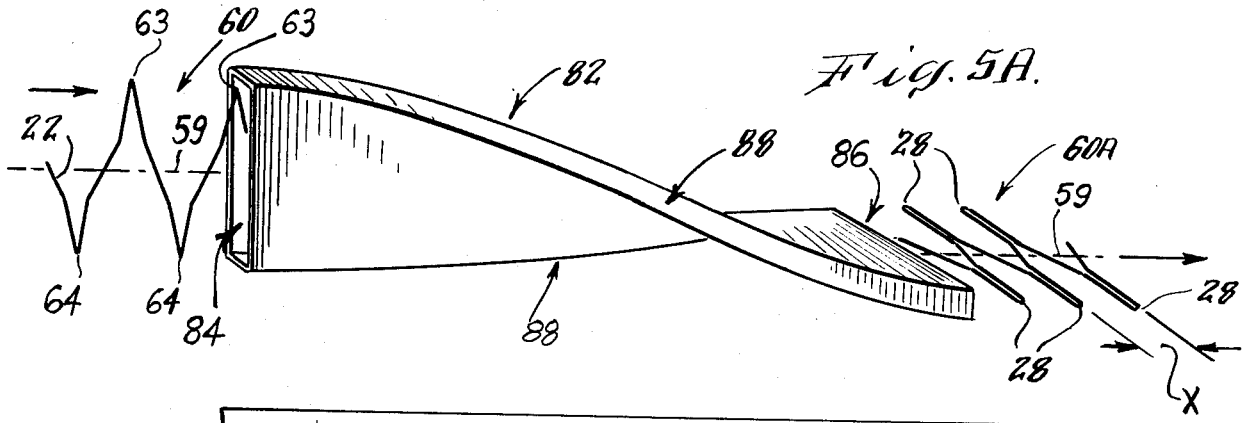
Fig. 5A.
Fig. 5B.
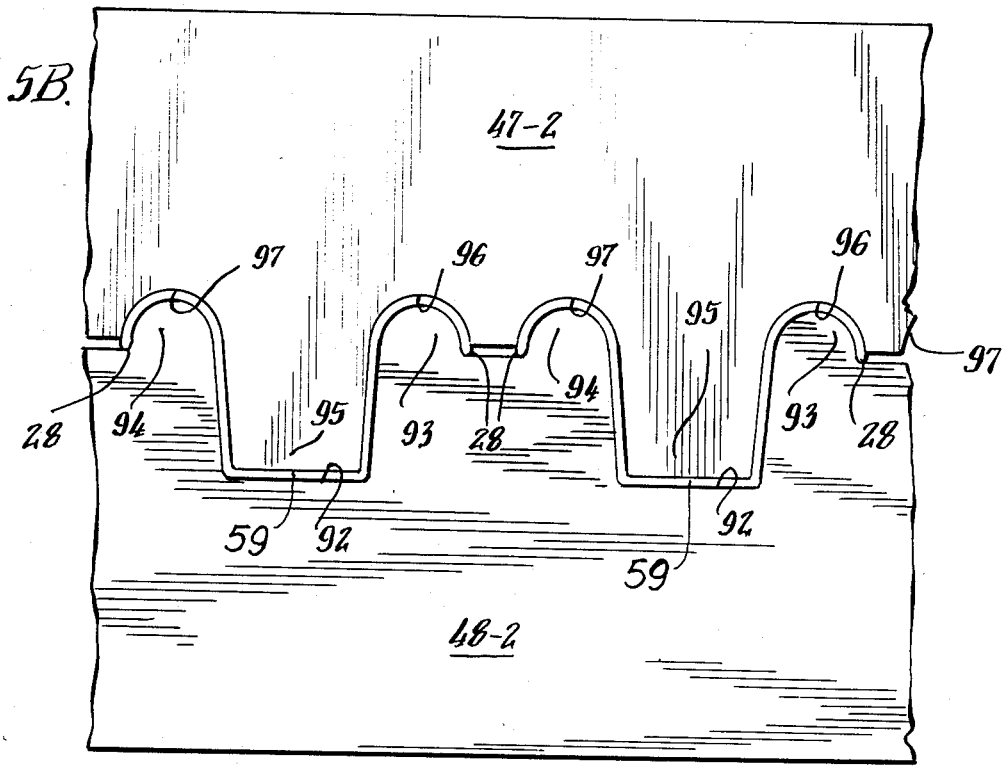
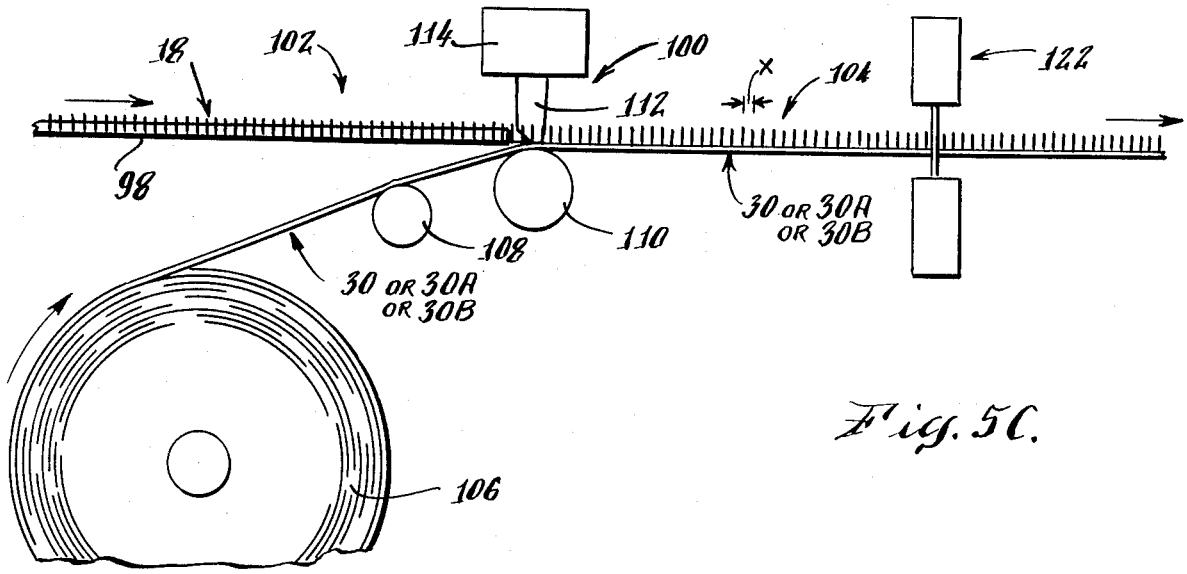
Fig. 5C.

MULTIPLE HOOK FASTENER MEDIA AND METHOD AND SYSTEM FOR MAKING

FIELD OF THE INVENTION

This invention is in the field of hook and loop fasteners, and more specifically the invention relates to the hook-fastener medium for providing hook-like gripping engagement with an opposed area containing multiple accessible loops or fibers forming multiple accessible apertures. The hook-fastener medium contains multiple small hooks protruding from one face. This hook-fastener medium is brought into contact with a second fastener area containing multiple loops or multiple fibers forming loop-like apertures, herein called the "loop medium". The hooks become engaged in hook-like fashion with the loops or loop-like apertures of the loop medium for attaching the hook-fastener medium to the loop medium. Subsequently, if desired, the hook-fastener medium can be separated from the loop medium by forcefully pulling them apart, and often such forceful separation is most easily achieved by a "peeling" action. Such hook and loop fasteners are usually intended to be capable of being separated and refastened together at least several times during their lifetime.

BACKGROUND OF THE INVENTION

There exist in the marketplace today a number of different hook-fastener media to be described below. It is my belief that each of these existing hook-fasteners suffers from one or more shortcomings which hamper their utility and utilization.

1. Woven hook-fastener medium:

The original hook-fastener medium is fabricated by a needle loom, and it is currently made as a tape approximately one to four inches wide having a selvage along each margin of the tape, the tape has a woven substrate with an oriented monofilament woven by the loom into the substrate while the substrate itself is being woven. This monofilament is woven with periodic protruding loops which are thereafter heat set and subsequently picked up in the loom or in a secondary machine by small needles. Associated with these small needles are small cutters which serve to cut each loop at a cutting position which is oriented between 3 o'clock and 4 o'clock. Each cut loop thus forms a protruding hook, but there remains a stub of each cut loop standing closely adjacent to the tip of the hook.

One of the shortcomings of this woven hook-fastener medium is that the loops are not always cut, and the stubs which remain near the cut tips of the hooks interfere with and prevent the desired hooking engagement with an opposed loop medium. Consequently, a significant number of the hooks do not engage into the loops or apertures. In other words, the hooking efficiency is reduced by the presence of the stubs and uncut loops.

A second shortcoming of the woven hook-fastener medium results from the fact that any given needle loom can produce only one size of cut hooks. The cut hooks are always formed of monofilaments of the same characteristics and same denier, and the tape is always of the same width. In other words, there is no possibility of adjusting the loom for producing different widths of tapes or different sizes of cut hooks or different spaces between the hooks or different characteristics of the hooks, such as different resilience or different hooking strengths. In summary, the loom can slowly produce only one product.

A third shortcoming of this woven hook-fastener medium results from the fact that the woven-in monofilaments which form the cut hooks must be bonded into the woven substrate for preventing their extraction from the substrate whenever the hook medium is forcefully separated from a loop medium by pulling them apart. The lower surface of the woven substrate is coated with a tacky bonding agent. Then, this bonding agent is cured for permanently anchoring the cut hooks into the woven substrate. This bonding agent causes the lower surface of the woven substrate to have a glazed appearance. The woven tape as a whole has an unattractive stiffness and has an unattractive "feel" as compared with ordinary woven fabric tapes.

The fourth and most important shortcoming of the woven hook-fastener medium is its relatively great expense, caused by the slow speed at which the tape can be woven in a needle loom. Such needle looms are very complex, with many intricate small parts. Increasing the width of the woven tape slows the lineal production speed, because increasing the width of the loom inherently slows down its lineal production speed, thus increasing the cost per unit length. The relatively high cost of the woven hook-fastener medium has restricted and limited its commercial applications, for example, to closures for expensive clothing and sporting shoes, closures for watch bands, and the like.

2. Molded hook-fastener media:

During the time period from early 1961 to mid 1972, the present inventor was previously active in this hook and loop fastener field, as shown by U.S. Pat. Nos.

| | | |
|---|---|---|
| 3,147,527 | 3,586,060 | 3,708,382 |
| 3,196,490 | 3,594,863 | 3,715,415 |
| 3,546,754 | 3,594,865 | 3,732,604 |
| 3,550,223 | 3,595,059 | 3,735,468 |
| 3,550,837 | 3,629,032 | 3,781,398 |
| 3,562,044 | 3,665,584 | 3,801,245 |
| 3,562,770 | 3,695,976 | |

In order to increase the production speed for making hook-fastener media beyond the speed which is possible for the woven-type as described under section 1 above, the present inventor conceived and developed a molded hook-fastener. The hooks are molded of plastic material integral with a substrate layer. Thus, the lineal production speed of the substrate with the hooks protruding can be considerably increased, as compared with the operation of the slow-speed, intricate needle loom.

Some molding machines of the present inventor were subsequently modified to produce a double-hook having two hook-shaped heads on each single shank. These hook-shaped heads are located on opposite sides of the shank, i.e. they are angularly spaced 180° about the longitudinal axis of the shank, similar to the double-hook on the shank of an anchor from an old sailing vessel. Such a molded double-hook-fastener medium has a strong gripping effect on the loop medium. It is difficult to separate them. If sufficient pulling, peeling force is applied to separate the molded double-hook-fastener from the loop medium, many of the loops become broken or torn apart. Thus, the molded double-hook-fastener medium is best suited to permanent industrial-type attachments.

One shortcoming of these molded hook-fastener media results from the fact that the hooks must be molded of a relatively stiff plastic material in order for them to have sufficient strength to provide the desired hook-like gripping engagement with the loop medium. Since the hooks are molded integral with the substrate tape, this tape itself has a relatively stiff rigidity, which makes the molded hook-fastener media unsuitable or unattractive for use in visible locations or as closures on clothing. Thus, the molded hook-fastener media, whether single-hook or double-hook, are limited to industrial-type uses in hidden locations, for example, to secure floor pads in place in vehicles.

Another shortcoming of the molded hook-fastener media is the expense of replacing the molding plates of the molding machine to change the size or characteristics of the hooks. Also, a relatively narrow tape is produced, and its width cannot be adjusted, so it produces only one product, but it is very considerably faster than the original needle loom.

3. Molded mushroom-hook-fastener medium:

A variation of the molded single-hook or double-hook fastener media is to form a mushroom-shaped head on the protruding shank of the hook. Such mushroom heads can be molded onto each shank in the first instance. Alternatively, the outer end of each shank can be "upset" by heat and pressure in order to forge the mushroom heads on the shanks.

Such a molded mushroom-hook-fastener medium has a strong gripping effect on the loop medium, and they are difficult to separate. When sufficient pulling, peeling force is applied to separate these fasteners, numbers of the mushroom heads become snapped off of their shanks or the shanks are snapped off at their roots. Therefore, mushroom fasteners are best suited to permanent industrial-type attachments.

In summary, all three molded-type hook fasteners (single-hook, double-hook, or mushroom head) suffer from the disadvantage that the substrate must be molded from the same material as the hooks. It is not possible, up to the present time, to make the substrate of attractive, desirable, compliant material different from the stiff, plastic material used to mold the hooks.

SUMMARY OF THE PRESENT INVENTION

In accordance with the present invention, the protruding hooks can be formed of a different material from the substrate and then are bonded onto the precoated substrate. Thus, a very desirable and attractive material can be used to make the substrate. The substrate may be of any reasonable width: for example, three inches wide, six inches wide, a foot wide, a yard wide.

The production method and system of this invention enable the number of hooks per square inch to be adjusted while running, i.e., the hook concentration or density per unit length can be varied, as desired for various products and for various fastener applications.

In addition, while running, the production method and system can be adjusted for making hooks with crossed legs or with uncrossed legs or with divergent legs, because the shank portion of each hook includes two legs.

Advantageously, the production method and system can also be changed by replacing the shaping belts for making taller or shorter hooks. The shaping belts may include multiple sub-belts, each of which may produce hook fasteners of differing shapes, sizes or characteristics for simultaneously producing different hook-fastener media in parallel flow relationship on one machine.

Thus, the hook characteristics can advantageously be adjusted over a wide range for providing different types and shapes of hooks on different types of substrate material of any reasonable, desired width. The substrate material may be woven or unwoven and may comprise more than one layer and may include metal or plastic or layers of both.

The substrate can be slit longitudinally after the hooks have been bonded onto the substrate, for producing several tapes simultaneously at a relatively fast overall lineal production speed, as compared with known woven or molding equipment as described above.

In addition, the present invention holds the promise, I believe, of fast and low-cost production. Consequently, the hook-fastener media of this invention with their various sizes and shapes and various widths and characteristics, hold the promise of becoming widely available, widely used, relatively low cost, commodity-type products which will find their way into myriads of new applications of benefit to human beings in the years to come.

In accordance with the invention, many rows of hooks are formed, each row from a strand of plastic material, for example, preferably from a monofilament of longitudinally oriented polymeric material. The strand is formed and then "set" into its multiple hook row configuration in a high-speed operation separate from the substrate. Then these rows of pre-formed multiple hooks are bonded onto the substrate.

In production, many strands are fed in spaced parallel relationship to be formed and then "set" at high speed into many rows of pre-formed hooks. Then these preformed rows of hooks are all bonded unto a substrate layer for achieving lineal production rate which is several times faster than in a needle loom. The various strands can be of different predetermined colors, if desired. Since the substrate may be a foot wide, or more, and since it can be slit longitudinally after the hooks have been bonded to it, the acutal lineal production rate of hook-fastener tape one-inch wide embodying this invention can be twenty to fifty times faster, or more, than in a needle loom as used today. Also, the various slit tapes can have hook features of respective different colors.

In accordance with the present invention in one of its aspects, there is provided a multiple-hook fastener medium for providing hook-like gripping engagement with an opposed loop medium containing multiple accessible apertures into which the multiple hooks can become engaged by bringing the hook-fastener medium into contact with the opposed loop medium comprising a substrate area, a plurality of spaced parallel rows of multiple hooks mounted on the substrate area with said rows extending longitudinally along the substrate area, each row including a first plurality of identical spaced, aligned left hooks facing outwardly from the left lateral side of the row, and each row also including a second plurality of identical, spaced, aligned right hooks facing outwardly from the right lateral side of the row. All of the left and right hooks of the first and second pluralities of hooks in each row are formed from a respective strand of bendable and settable polymeric plastic material, with the respective strand extending back and forth in zig-zag manner between the respective successive left and right hooks of each row, and with the zig-zag extending portions of each strand being bonded to the substrate area.

In accordance with the present invention in another of its aspects, an advantageous relatively low-cost, high production rate method and system are provided for making hook fastener media of improved and variable characteristics and sizes. Many strands of bendable, settable polymeric material are fed in spaced parallel relationship into a first shaping zone between the interdigitating (meshing) teeth of a pair of opposed forming belts for bending and setting each of the strands into an intermediate zig-zag configuration by heat softening the strands during bending and then cooling them to "set" the shape. These intermediate zig-zag strands are then fed into a second shaping zone between the interdigitating teeth of a second pair of opposed forming belts for bending and setting the tip portions of the respective zigs and zags of each strand into left-facing and right-facing hooks arranged in a row, with the shank portion of each hook having two legs. Then, the zig-zag extending portions of each row of hooks are bonded to a substrate, for example, by ultrasonic welding for completing the hook fastener.

By virtue of the zig-zag configuration of the intermediate strands, the concentration or density of the hooks are adjusted during production by adjusting the pitch of the respective zigs and zags.

Also, by virtue of the fact that the tip of each hook is a tightly formed U-bend in the strand, there is bulging of the polymeric material in the bight of the bend which acts somewhat like a rounded, slight barb on a fish hook for strengthening the hook-like gripping engagement with the loop medium.

As indicated previously, the configuration of the two legs of each hook is adjusted for obtaining a variety of hook characteristics, with crossed legs, uncrossed legs or divergent legs.

BRIEF DESCRIPTION OF THE DRAWINGS

The foregoing and other aspects, objects, features and advantages of the invention will become more fully understood from the following description of a preferred embodiment of the invention, as illustrated in the accompanying drawings, in which like reference characters refer to the same parts throughout the different views. The drawings are not necessarily to scale, emphasis instead being placed upon illustrating the principles of the invention.

Returning attention to FIGS. 2 and 4, the relative height of the protruding hooks in the "Z" dimension is changed by using a different pair of interdigitating forming belts in the second zones. The overall size of the zigs and zags is changed by using a different pair of interdigitating belts in the first zones.

Figure 1:
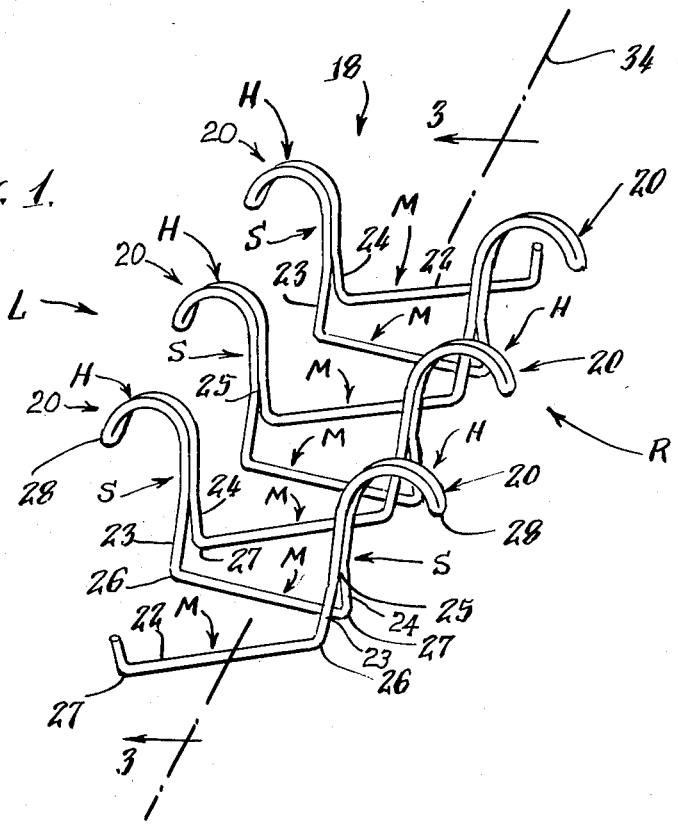
FIG. 1 is a greatly enlarged perspective view of a row of left-facing and right-facing hooks formed from a strand of bendable and settable polymeric material in accordance with this invention.

Inviting attention to the drawings in greater detail, FIG. 1 shows a row 18 of identical hooks 20, formed from a strand 22, with left-facing and right-facing hooks in the lateral regions L and R, respectively, of the row 18. Each hook 20 includes a curved arch-shaped head portion H, with a shank portion S extending between the head portion and a mounting portion M which extends between the respective left-facing and righ-facing hooks. The shank portions of each hook include two legs 23 and 24 formed from a pair of respective segments of the strand 22.

The strand 22 is a monofilament of polymeric plastic material which is stiffly flexible at room temperature and which becomes limply bendable at suitably elevated temperature. For example, this polymeric plastic material in the monofilament strand 22 may advantageously be Nylon polyamide.

The legs 23 and 24 converge upwardly and meet at a point 25 approximately one-half of the way up the shank S. Starting at the near end of the row 18, in FIG. 1, the strand 22 is seen to run from a bend 27 toward the right defining a first mounting portion M. Then the strand bends up abruptly at a foot bend 26 commencing the leg portion 23. Continuing up this leg portion 23, the strand is seen to converge toward the other leg 24, meeting with it at point 25. The strand then continues up the shank S from the meeting point 25 closely adjacent and parallel to the other leg and continues into the head portion H, arching up and over continuing to the tip of the hook at 28.

At the tip 28, the strand bends back upon itself in a sharp closely doubled-back U-bend, and the strand then again arches up and over parallel to itself through the head H continuing down through the shank S again to the point 25. Continuing down from point 25 the strand is seen in leg 24 to diverge from leg 23 until the strand reaches the other foot bend 27. From this foot bend 27 the strand is seen to run toward the left defining a second mounting portion M. The strand then bends up abruptly at another foot bend 26 leading to the leg 23 of a left-facing hook 20, and continuing so forth, back and forth along the row 18.

Looking at the mounting portions M of the strand 22 in the row 18, the strand is seen to zig-zag back and forth as it extends from a foot bend 27 of one outwardly facing hook to the foot bend 26 of the next sequential hook, which faces laterally outwardly in the opposite direction from the previous hook. Thus the strand continues to zig-zag back and forth forming the row 18 hooks 20.

Figure 2:
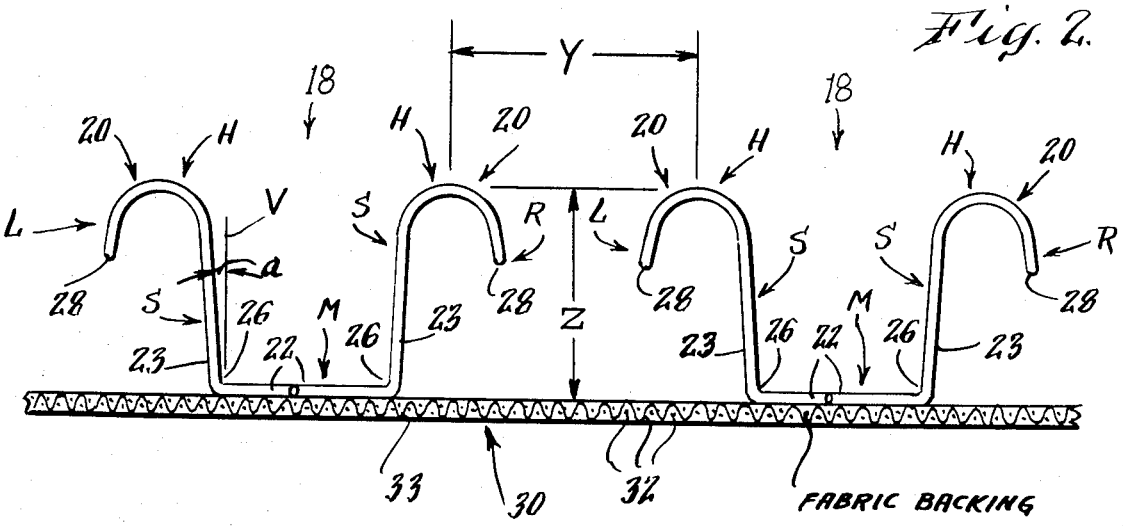
FIG. 2 is a further enlarged cross-sectional view showing two rows of these hooks bonded onto the substrate.

As shown in FIG. 2, the mounting portions M of the respective rows 18 of hooks 20 are bonded to a backing material 30, which may be called a substrate, for holding the rows 18 of hooks 20 which protrude to a height Z above the upper surface of this substrate 30. This substrate 30 may comprise any suitable layer or layers of woven or non-woven material. In FIG. 2, the substrate 30 is shown as a woven fabric material 33.

The mounting portions M can be bonded to the backing 30 by any suitable settable adhesive. However, in this preferred embodiment of FIGS. 1, 2 and 3, the bonding is achieved by ultrasonic welding. A strong, neat ultrasonic weld can be achieved between two Nylon polymeric materials, Consequently, when using a woven substrate, the threads 32 which are woven into the fabric 33 include a relatively large percentage of suitable ultrasonic bendable Nylon polymeric material When using a non-woven substrate, it may be precoated with a suitable ultrasonic bondable coating.

Figure 3:
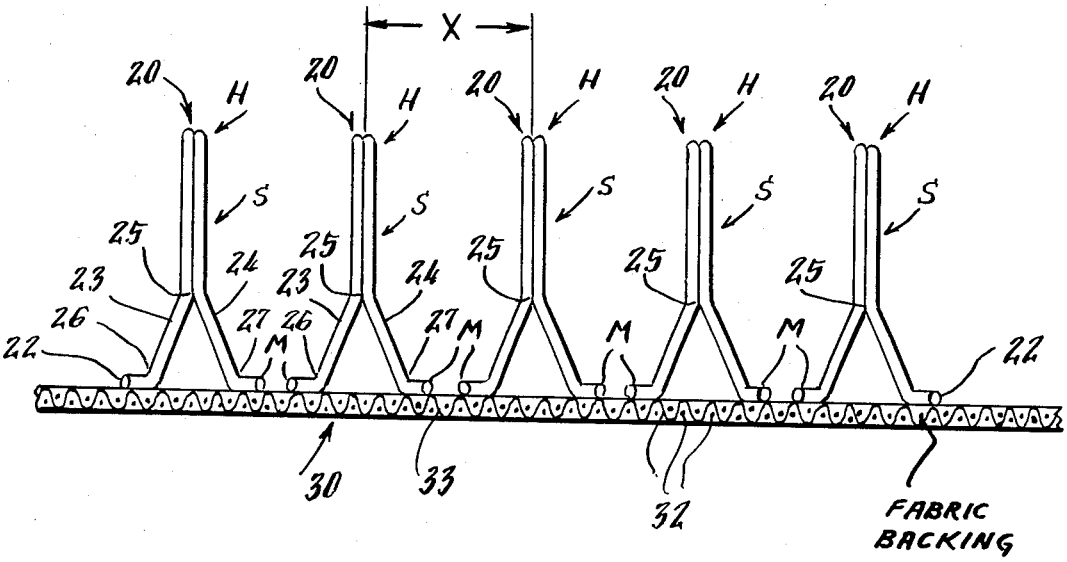
FIG. 3 is a vertical sectional view taken along the line 3—3 in FIG. 1, looking toward the left.

In FIG. 3, the upwardly converging legs 23 and 24 are most clearly seen meeting at the point 25. This view is a section taken along the center line 34 (FIG. 1) of the row 18 looking toward the left. Each hook 20 in FIG. 3 is seen to have an inverted Y-shape.

Figure 4:
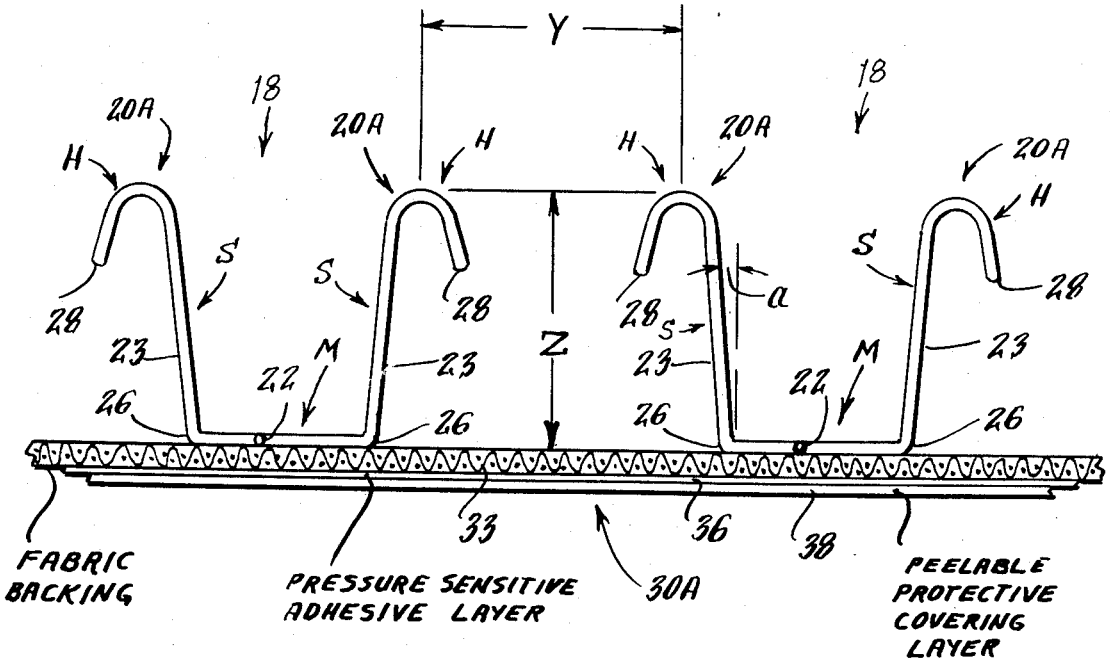
FIG. 4 is a view similar to FIG. 2 showing two rows of hooks bonded onto a substrate. The substrate has different characteristics from the one shown in FIG. 2, and the hooks have a different shape.

A comparison of FIG. 4 with FIG. 2 will begin to give an appreciation of the large variety and variations of hook configurations which can be readily and conveniently fabricated in the hook media in accord with this invention. In the embodiment of FIG. 4, the hooks 20A in each row 18 have a different shape from the hooks 20 in FIG. 2, and the substrate 30A is different from the substrate 30. For example, this substrate 30A includes a fabric layer 33 plus a lower layer 36 of pressure-sensitive adhesive with a peelable sheet 38 covering and protecting the adhesive 36. In use, the protective sheet 38 is peeled off from the pressure-sensitive adhesive 36 for exposing this adhesive, so that the fabric substrate 30A can be adhered to any area desired to be fastenable by the rows 18 of hooks 20A.

It is noted that the head portions H of the hooks 20A in FIG. 4 are smaller than the head portions H of the hooks 20 in FIG. 2. The shank S of the hooks 20A are longer, and these shanks diverge upwardly at a somewhat widerangle than in FIG. 2. For example, in FIG. 2 each shank S inclines outwardly from a vertical line V at an angle "a" of less than 4°. In FIG. 4, each shank S inclines outwardly from a vertical line V at a predetermined fixed angle "a" in the range from 3° to 9°.

Also, in FIG. 4, the rows 18 are spaced laterally farther apart than are the rows 18 in FIG. 2. The smaller head hooks of FIG. 4 more readily enter into the apertures of the loop medium, and the wider spacing of the rows facilitates the entry of each hook into the apertures of the loop medium. Consequently, it is relatively easy to achieve a hooking engagement with hooks of the small head configuration of FIG. 4. Only very light and quick contact pressure against the loop medium is sufficient to achieve hooking engagement.

However, the smaller head hooks of FIG. 4 will engage fewer fibers of the loop medium, and hence the fastening engagement is less inclusive of the loop medium than occurs with the embodiment of FIG. 2.

Figure 5:
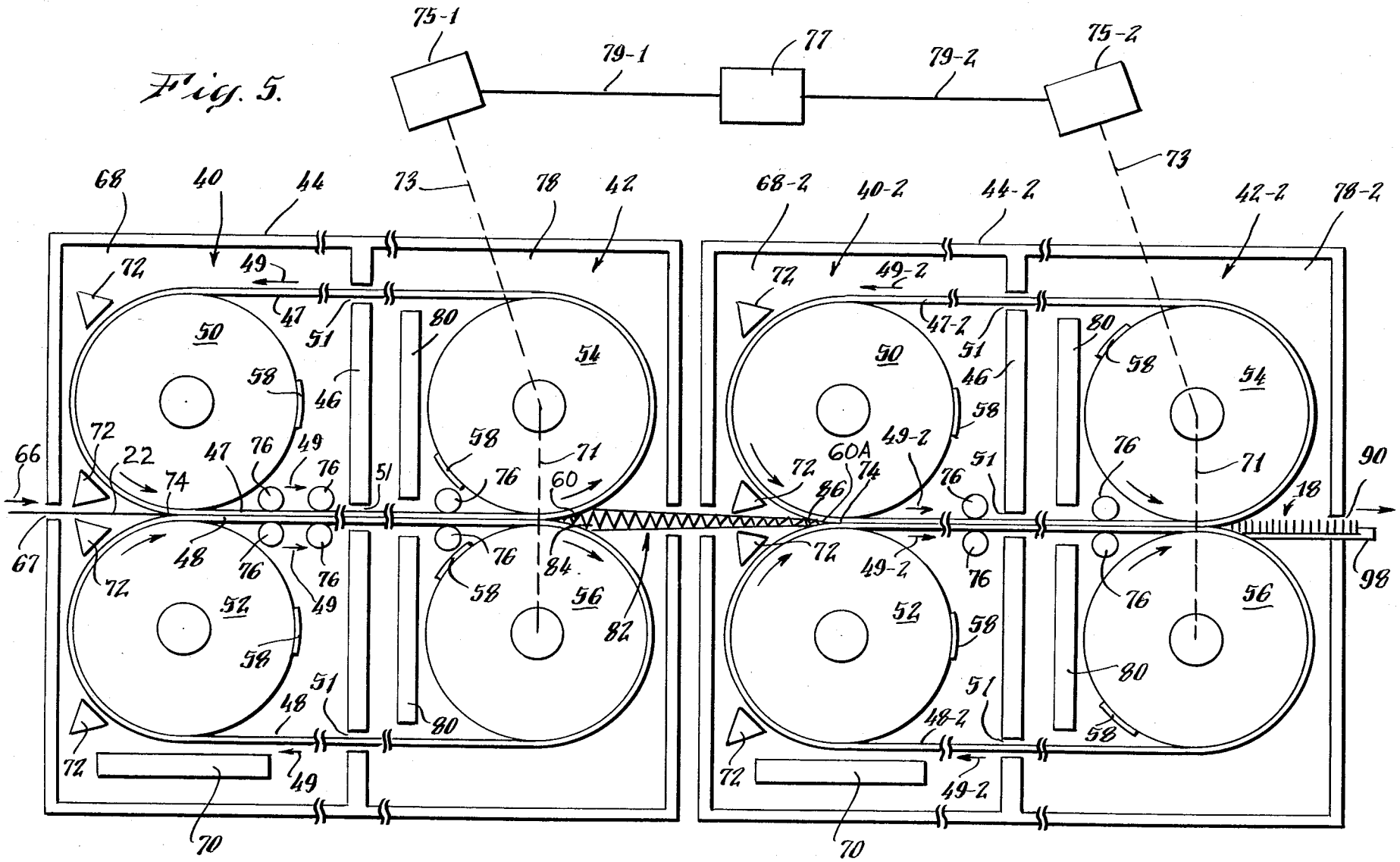
FIG. 5 is a schematic diagram of the production method and system embodying this invention, including first and second shaping and setting zones.

In the production method and system shown in FIG. 5, there is a first shaping zone 40 and a first setting zone 42 both located within the same thermally insulated housing 44. A thermally insulated vertical partition 46 within this housing separates shaping zone 40 from the setting zone 42. A pair of endless flexible shaping belts 47 and 48 revolve in synchronism in opposite directions, as shown by the arrows 49. The upper shaping belt 47 is revolving counterclockwise and the lower shaping belt 48 clockwise, passing through respective narrow horizontally elongated ports 51 in the partition 46. The upper belt 47 revolves around input and output rolls 50 and 54, respectively, while the lower 48 revolves around input and output rolls 52 and 56, respectively.

For facilitating the manufacture and maintenance of the shaping belts 47 and 48, they each comprise a plurality of narrower sub-belts. For example, each sub-belt is three inches wide, and four of them are assembled together in parallel edge-to-edge relationship on their respective rolls for providing a shaping belt 47 or 48 having an overall width of approximately twelve inches. For guiding each of these sub-belts and keeping them tracking together in parallel relationship, the rolls 50, 52, 54 and 56 each has a plurality of narrow circumferentially extending pulley-type peripheral flanges, as indicated partially at 58, and these narrow guiding flanges 58 are spaced apart three inches for straddling the sub-belts.

If wider shaping belts 47 and 48 are desired for further increasing the production rate of the hook media, then longer rolls 50, 52, 54 and 56 are provided having more of these pulley-type flanges, and more of the narrow sub-belts are utilized for providing shaping belts 47 and 48 which are two feet wide or a yard wide, and so forth.

The widths of these two shaping belts 47 and 48 in any particular installation are always the same, because they work in opposition to each other. The belts 47 and 48 are preferably made of stainless steel. The front surfaces (outer surfaces) of the respective belts 47 and 48 include multiplicities of parallel, axially extending and circumferentially spaced teeth 61 and 62, respectively, as shown greatly enlarged in FIG. 6 for shaping and setting the strand 22 into the intermediate corrugated configuration 60. This initial corrugated configuration 60 includes sharp peaks 63 and sharp valleys (inverted peaks) 64 with sloping shoulders 65 interconnecting these peaks and valleys. In other words, the strand 22 is bent back and forth zig-zag fashion 60 in a vertical plane on opposite sides of a centerline 59 (FIG. 5A) with equal size sharp U-bend peaks 63, 64 facing in opposite directions from said centerline.

It will be seen that the peaks and valleys 63 and 64 of this intermediate corrugation 60 will subsequently become shaped into the tips 28 (FIGS. 1-4) and head and shank portions H and S of the respective left-facing and right-facing hooks 20 or 20A in a row 18. The sloping shoulders 65 will become shaped into the diverging legs 23 and 24 and into the zig-zag mounting portions M.

A relatively large number of the strands 22 (only one is seen) are simultaneously fed in closely spaced parallel relationship through an entrance port 67. This entrance port 67 is as wide as the belts 47, 48 but is narrow in its vertical dimension. These multiple entering strands 22 are travelling toward the shaping zone 40 (FIG. 5) as shown by the arrow 66. In order to shape these entering strands 66, 22 into the intermediate corrugated shape 60, a first chamber 68 in the housing 44, which the zone 40 is located, is heated by means of a gas or other heater 70 to a temperature slightly above the softening temperature of the monofilament polymeric material of the entering strands 66, 22. For example, in the case of Nylon polymer, this heater 70 is adjusted to heat the chamber 68 to a suitable temperature level. A sequence of radiant heaters 72 are aimed at the front surfaces of the two revolving belts as they travel around the respective input rolls 50 and 52 just prior to their reaching the nip region 74 between these two rolls 50 and 52. These radiant heaters 72 may locally elevate the temperature of the teeth 61, 62 (FIG. 6) slightly above the average temperature in the chamber 68, if desired for enhancing the plastic softening action near the relatively sharp peaks and valleys 63, 64.

Figure 6:
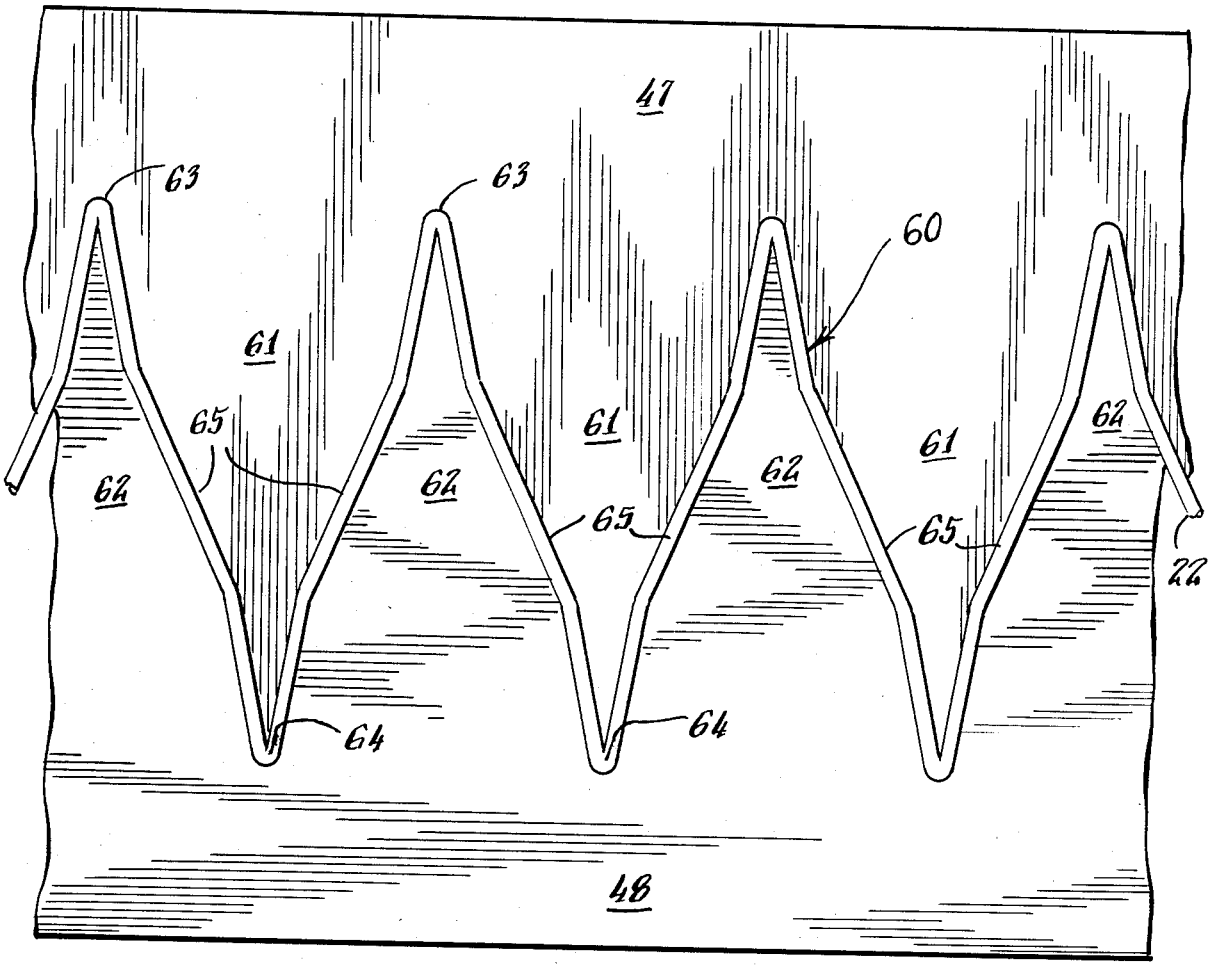
FIG. 6 shows the initial zig-zag configuration of one of the strands after it issues from the first shaping and setting zones and prior to its entry into the second shaping and setting zones.

In the nip region 74 these teeth 61, 62 mesh in interdigitated relation with the multiple strands becoming corrugated between them as seen in FIG. 6. The diameter of the rolls 50 and 52 is sufficiently large relative to the thickness of the stainless steel belts 47, 48 and relative to the pitch of their teeth 61, 62, that these belts will flex around these rolls at stresses well below their yield point. Thus, the teeth become meshed gradually without interference between them and with the entering strands 66, 22 captured between them as the belts move into the nip region 74, thereby corrugating the strands.

A plurality of smaller diameter rollers 76 extending transversely and engaging the rear (inside) surfaces of the belts 47 and 48 support and guide these meshed belts as they travel downstream from the nip region 74. The intermeshing of the heated teeth 61, 62 with the many parallel strands 66, 22 between them shapes these strands into the corrugated configuration 60 (FIG. 6).

In order to "set" this corrugated configuration 60, the meshed belts travel downstream through the narrow port 51 in partition 46 and enter a cooling chamber 78 in which the setting zone 42 is located for cooling them to a stable, lower temperature. Thus the strands become set into their intermediate corrugated shape 60. In this zone 42 the belts are cooled down to a suitable temperature by means of coolers 80 containing cooling fans blowing onto the rear surfaces of the meshed belts. Also, the output rolls 54 and 56 are hollow and are cooled by circulating cold water through them.

The output rolls 54 and 56 are ganged together for rotation at the same peripheral speed in opposite directions by a mechanical interconnection 71, for example, by a gear train or by sprockets and a timing chain. These two rolls 54, 56 are driven through a transmission 73 by a controllable speed drive motor 75-1. The speed of the drive means 75-1 is under control of a control station 77 which is electrically connected to the drive means 75-1 through an electrical cable 79-1.

As each corrugated strand 60 exits from between the first pair of belts 47, 48, it is captured in a guide passageway 82 (please see FIG. 5A). This guide passageway 82 has a tall narrow rectangular configuration at its entry 84, and it gradually twists 90° in a helical path as seen enlarged in FIG. 5A into a wide narrow horizontal rectangular configuration at its exit 86. The purpose of each guide passageway 82 is to change the orientation of the plane of the corrugated strand 60 passing through it from vertical to horizontal.

The guide passageways 82 extend in parallel relationship from the thermally insulated housing 44 into a second similar housing 44-2 containing a second pair of revolving heated and cooled endless flexible shaping belts 47-2 and 48-2 revolving in synchronism in opposite directions through a second shaping zone 40-2 and a second setting zone 42-2.

Figure 7:
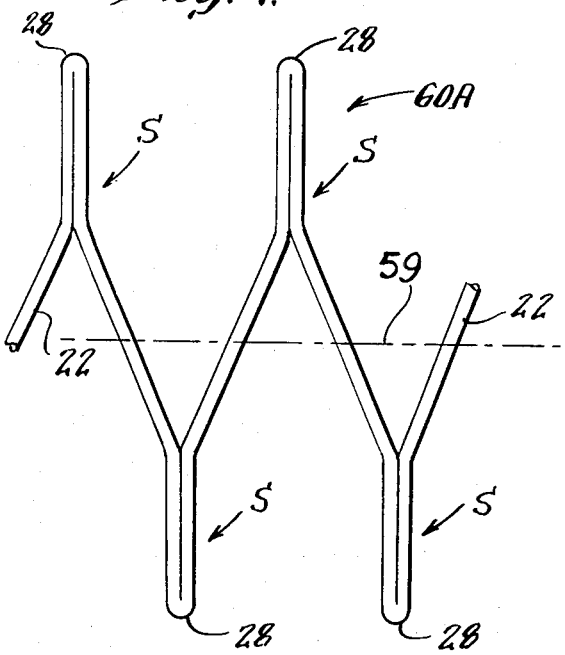
FIG. 7 shows the final zig-zag configuration of the strand of FIG. 6 after the pitch of the zigs and zags has been adjusted just prior to entry into the second zones. Thus, by changing the relative rates of lineal feed as between the first and second zones, the pitch of the zigs and zags in the intermediate strands is adjusted for varying the concentration or density of the hooks in the longitudinal direction "X" of the hook-fastener medium. In other words, changes in hook density in the longitudinal "X" dimension are conveniently made during production by adjusting the relative lineal speeds as between a first and a second shaping and setting zone.

In order to cause the portions of strand 22 forming the peaks 63 and valleys 64 of the corrugated strand 60 (FIG.6) to close into adjacent relationship, as shown in the partially closed corrugated configuration 60A in FIG. 7 ready for use in fabricating the tips 28 and shanks S of the hooks 20 or 20A, the second pair of shaping and setting belts 47-2 and 48-2 are moved at a slower lineal speed than the first pair 47, 48. The controllable-speed drive motor 75-2 for the second pair of belts is connected through an electrical cable 79-2 to the control station 77. Thus, the operator uses speed controls in the station 77 for setting the lineal speed of the second pair of belts 47-2, 48-2 relative to the lineal speed of the first pair of belts 47, 48 for producing the partially closed corrugated configuration 60A (FIG. 7) of the strand 22 which enters into the nip region 74 (FIG. 5) between the second pair of belts.

In order to facilitate the fabrication of the sharp U-bends 28, during the partial closing of the corrugations during the transition from 60 to 60A in the guide 82, a pair of elongaged electrical heater strips 88 (FIG. 5A) may be extended along the two narrow edges of this helical guide passageway 82 for softening the strand 22 at the tips 28 for producing these sharp bends.

The second pair of belts 47-2, 48-2 convert each horizontally oriented, partially closed corrugated configuration 60A into a row 18 of hooks 20 or 20A, as shown in FIGS. 1, 2 and 4. These rows 18 of hooks (only one is seen) issue at the right (FIG. 5) from the second housing 44-2 through an exit opening 90.

As shown greatly enlarged in partial cross section in FIG. 5B, the front (outer) face of the lower belt 48-2 includes a plurality of laterally spaced, longitudinally extending parallel grooves 92 with a longitudinally extending double hump 93, 94 between successive grooves. On the other hand, the front face of the upper belt 47-2 includes a plurality of laterally spaced, longitudinally extending parallel ridges 95 with a longitudinally extending double groove 96, 97 between successive ridges. These two belts mesh together as shown in FIG. 5B with sufficient clearance between them for the corrugated configuration 60A strands 22 to become sandwiched between them for final shaping in the second shaping zone 40-2 located in the second shaping chamber 68-2. Then the rows 18 of heat-softened hooks 20 or 20A are "set" by cooling of the belts in the second setting zone 42-2 located within the second setting chamber 78-2.

The rows 18 of hooks are carried out through the exit 90 (FIG. 5) by a plurality of substantially parallel channel-shaped guides or chutes 98 leading the rows 18 of hooks into the bonding zone 100 (FIG. 5C) where the mounting portions M of these rows are bonded by welding onto any compatible substrate 30 or 30A or 30B as may be desired. These guides 98 are described as being substantially parallel, because they can be laterally adjusted in the region 102 for converging or diverging the rows 18 for producing hook media 104 having, respectively, increased or decreased densities of hooks, i.e., more or less hooks per square inch. By converging the channel guides 98, the rows 18 become more closely spaced in the lateral "Y" direction (FIGS. 2 and 4) and vice versa.

The substrate 30 or 30A or 30B is supplied from a roll 106 and passes over a guide roller 108 and then passes above an anvil roll 110 having an extremely hard durable surface, for example, a steel roll having a deep case-hardened nitrided surface. In opposed relationship to this anvil roll 110 are a plurality of ultrasonic welding probes 112 (only one is seen) each having a tapered horn shape having many tips and being ultrasonically vibrated by a driver 114. There is one of these welding horn tips 112 extending down into the region between the left-facing and right-facing hooks of each row 18 engaging the mounting portions M and welding them onto the substrate 30 or 30A or 30B.

If desired, the ultrasonic welding unit 114 may be placed below the substrate 30, 30A or 30B. For example, such a welding unit may include a vibrationally driven bar extending transversely across below the substrate. This ultrasonically vibrating bar extends transversely with respect to the direction of motion of the substrate and the hooks 18. A plurality of hardened anvil disc wheels are located above the rows of hooks 18 opposite the ultrasonic bar. The extremely hard, durable rims of these disc wheels serve as anvils, and they roll over the mounting portions M (FIGS. 1, 2, 4, 10) of the respective rolls of hooks for ultrasonically welding these mounting portions onto the substrate. The ultrasonic bar may have a smooth surface, or it may have a pattern of ridges or small bumps for concentrating the welding action at various localized regions with respect to each mounting portion M.

If desired, for providing additional capture and additional bonding strength, an additional strip of material may be fed upstream of the bonding station 100 (FIG. 5C) into the region between the row of left-facing hooks L and the row of right-facing hooks R. In other words, this additional strip is fed parallel to the centerline 34 over respective mounting portions M (FIG. 1). This strip is bonded to the backing for aiding in securing the mounting portions M to the backing (substrate).

This strip may be ultrasonically weldable or heat sealable or coated with pressure-sensitive adhesive of the permanent variety. There may be employed a second bonding station located downstream from the first bonding station for producing bonding or supplemental bonding of this additional strip.

When the channel guides 98 are laterally adjusted for changing the density of hooks in the hook media 104, other welding horns 112 are correspondingly substituted for maintaining alignment directly above the mounting portions M of each respective row 18 of hooks.

The hardened surface of the anvil roll 110 may have any desired pattern of ridges and depressions for concentrating the ultrasonic welding action into a particular pattern for increasing the flexiblity of the resultant welded hook media 104. For example, there may be a checkerboard or diamond pattern, or lattice pattern, of ridges and depressions.

As indicated previously, the longitudinal spacing of the hooks in the "X" direction (FIGS. 3, 5A and 5C) is accomplished by using the control station 77 for adjusting the relative speeds of the two sets of belts. The resultant changes in lateral "Y" direction are seen, for example, by comparing FIG. 10 with FIGS. 2 and 4.

Figure 10:
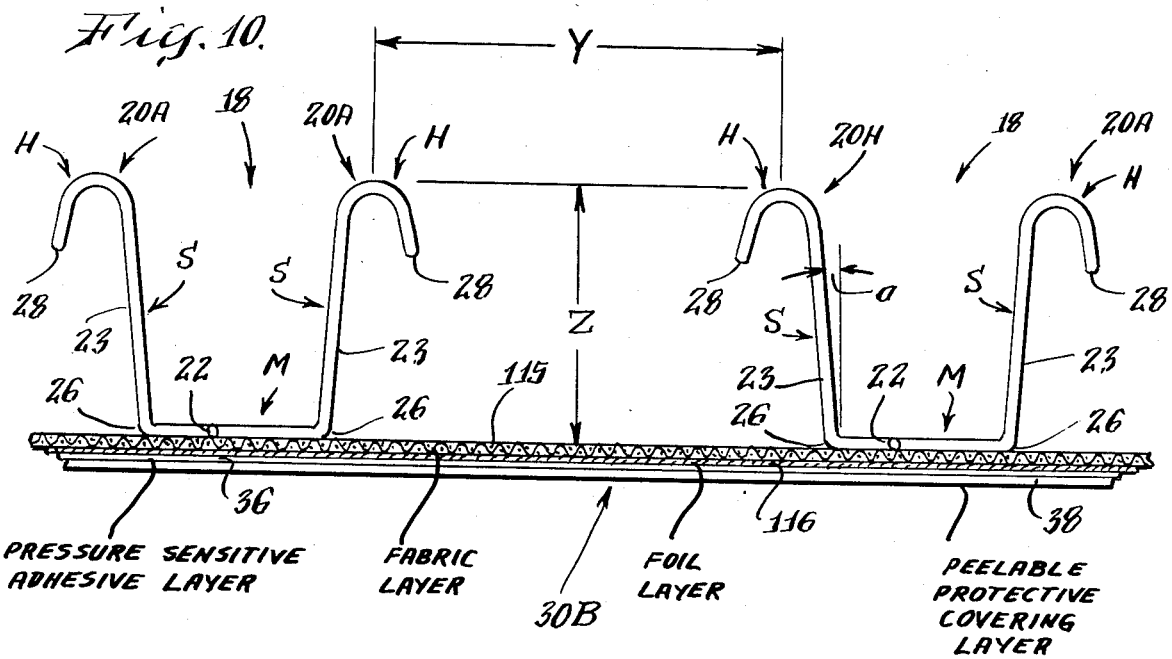
FIG. 10, compared with FIGS. 2 and 4, shows how changes in the hook density in the lateral "Y" dimension are conveniently made during production by adjusting the lateral spacing of the guide feed channels between the first and second zones.

Also, FIG. 10 shows a hook medium in which the substrate 30B includes an upper Nylon layer 115 bonded to a metal foil layer 116, for example, aluminum foil, having a pressure-sensitive adhesive layer 36 and a peelable protective covering sheet 38.

Figure 8:
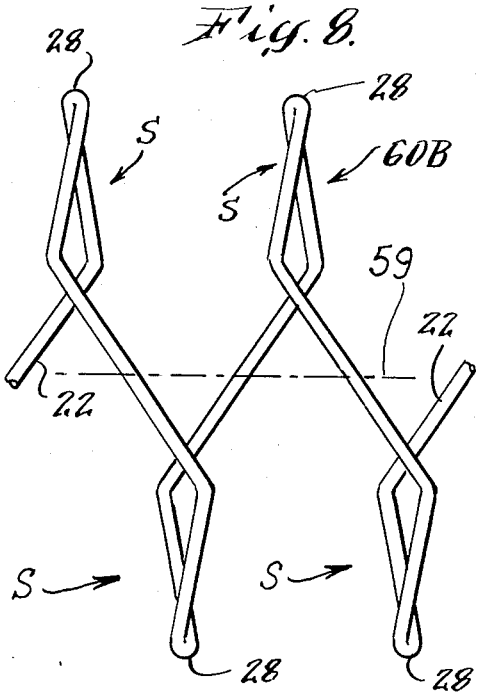
FIG. 8 shows that by appropriate adjustments in relative feed rates the two legs in the shanks of each hook can be crossed.
Figure 9:
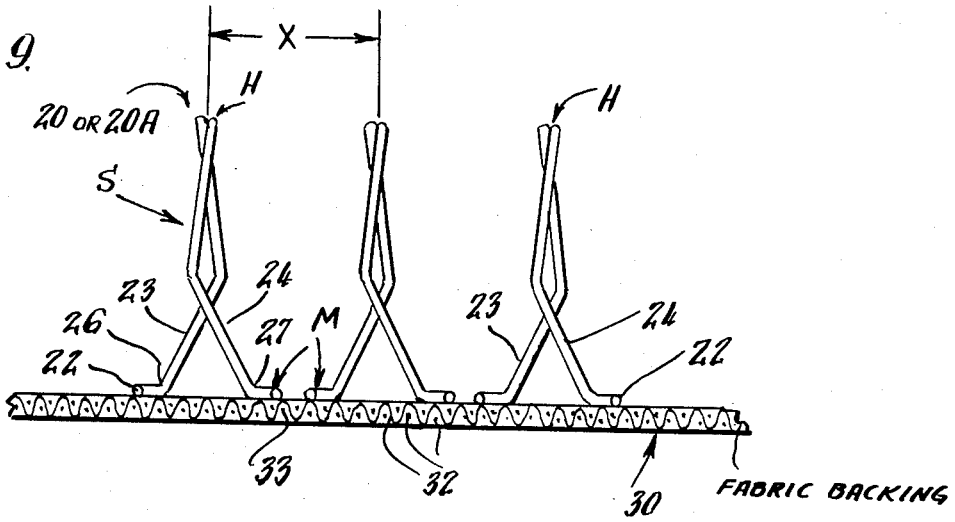
FIG. 9 is a view similar to FIG. 3 showing the resultant hook configuration with crossed legs.

In order to produce hooks in which the legs in the shanks of each hook are crossed as shown in the corrugated configuration 60B in FIG. 8 and in the cross section of a row of hooks in FIG. 9, the difference in the relative lineal rates 49 and 49-2 (FIG. 5) is increased.

Figure 11A:
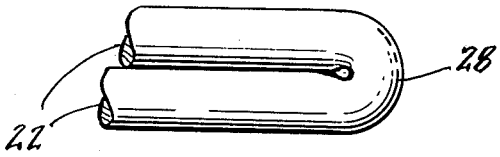
FIGS. 11A and 11B show a greatly enlarged plan view and side view, respectively, of the U-bent tip portion of a hook.
Figure 11B:
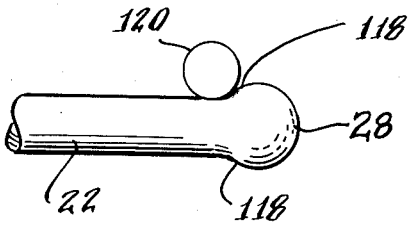

The present invention has the further advantage as shown in FIGS. 11A and 11B that the tip 28 of each hook is a tightly formed U-bend in the strand 22. Thus, there can be produced a bulging 118 of the polymeric material near the bight of the U-bend which acts somewhat like double barbs on a fish hook for strengthening the tiny hook like gripping engagement with a loop or fiber 120 of the loop medium.

In order to change the shape of the heads H of the hooks 20 or 20A, the second pair of belts 47-2 and 48-2 are changed to a pair having different front surface configurations, as will be understood by comparing FIGS. 2, 4 and 5B.

For changing the overall size of the hooks, both pairs of belts 47, 48 and 47-2, 48-2 are changed.

Thus, it will be understood that the present invention is very flexible in application. For example, the sub-belts comprising the respective pairs of belts 47, 48 and 47-2, 48-2 can be different on two sides of the apparatus and system shown in FIG. 5 for simultaneously producing two different kinds of hook media 104 (FIG. 5C). A slitting station 122 is included for slitting the hook medium 104 longitudinally into multiple strips, as may be desired.

Although the method and system for producing the hook-fastening media has been described as employing relatively wide belts 47, 48 and 47-2, 48-2 including multiple sub-belts, the invention can also be embodied to advantage in a method and system employing relatively narrow single belts 47, 48, 47-2 and 48-2, for example such single belts for producing hook-fastening media approximately one inch wide.

While the invention has been particularly shown and described with reference to preferred embodiments, it will be understood by those skilled in the art that various changes in form and details may be made without departing from the spirit and scope of the invention as defined by the appended claims and reasonable equivalents of the claimed steps and claimed elements.

I claim:

1. The method of making a multiple-hook fastener medium capable of hook-like gripping engagement with an opposed area containing multiple accessible apertures into which the hooks can become engaged by bringing said fastener medium into contact with said opposed area comprising the steps of:

forming at least one strand of a bendable, settable material back and forth in zig-zag configuration in a plane on opposite sides of a centerline for forming a plurality of spaced doubled-back portions of the strand facing in opposite directions from said centerline, again forming the strand near at least some of said doubled-back portions of the strand to form left-facing hooks and right-facing hooks on opposite sides of said centerline, respectively, upstanding from the plane of the zig-zag configuration with said doubled-back portions of the strand forming the tips of the hooks, setting material of said strand for causing the strand to retain said hooks, thereby preforming the strand into rows of preformed interconnected left-facing and right-facing hooks, and bonding the strand having said preformed interconnected hooks to a backing, said bonding being near said centerline with the hooks all upstanding from the same side of the backing for making the multiple-hook fastener medium.

2. The method as claimed in claim 1, including the steps of:

forming the strand near at least some of said doubled-back portions of the strand to form a pair of preformed sloping leg portions in each hook converging upwardly toward each other, and bonding the strand having said preformed interconnected hooks and pairs of upwardly converging leg portions to the backing with said pairs of leg portions upstanding from the backing and converging toward each other in a pair in each such hook for supporting the respective hook.

3. The method as claimed in claim 1, in which:

said crossing of the respective portions of the strand is carried out after said first setting step.

4. The method as claimed in claim 1, in which:

said hooks upstanding from the backing have head portions and shank portions, said crossing of respective portions of the strand near at least some of the respective sharp U-bends creates two crossing points near each respective sharp U-bend with one of said crossing points being nearer the associated U-bend than the other crossing point, and said bending of the strand near the respective crossing portions causes one of the crossing points to become positioned in the head of its associated hook and the other crossing point to become positioned in the shank of its associated hook.

5. The method as claimed in claim 1, including the steps of:

adjusting the number of hooks per square inch of the backing, by adjusting the pitch of the zig-zag configuration prior to bonding the strand of preformed interconnected hooks to the backing.

6. The method as claimed in claim 1, in which:

said step of setting material of said strand to retain said preformed interconnected hooks includes:

heat softening material of said strand in association with forming of the left-facing hooks and right-facing hooks, and cooling material of said strand after forming of said hooks for causing the strand to retain said hooks.

7. The method of making a multiple-hook fastener medium capable of hook-like gripping engagement, comprising the steps of:

zig-zagging at least one continuous strand of bendable settable polymeric material repeatedly back and forth across a centerline for forming a first plurality of bent tip portions of the strand projecting out from said centerline in a plane on a first side of the centerline and for forming a second plurality of bent tip portions of the strand projecting out from said centerline in said plane on the second side of the centerline, bending respective segments of the strand on opposite sides of the centerline for forming a first row of hooks and a second row of hooks all upstanding from said plane on the same side of the plane, with each hook having a bent over head portion located near a respective bent tip portion and each hook having a two-legged shank portion, the first row of hooks being located on the first side of the centerline with the respective hooks thereof including respective bent tip portions of said first plurality, and the second row of hooks being located on the second side of the centerline with the respective hooks thereof including respective bent tip portions of said second plurality, setting material of said strand for causing the strand to retain a first and second row of preformed interconnected hooks, and bonding portions of the strand near the centerline of said two rows of preformed interconnected hooks to a backing with the two rows of hooks upstanding from the backing all on the same side of the backing for making the multiple-hook fastener medium.

8. The method of making a multiple-hook fastener medium as claimed in claim 7, including the step of:

bending said strand of bendable, settable material back and forth zig-zag fashion on opposite sides of the centerline with the sharp U-bends alternating in occurrence on opposite sides of the centerline, bending the sharp U-bends on opposite sides of the centerline to form two rows of hooks alternating in occurrence on opposite sides of a centerline and facing outwardly away from the centerline in opposite directions with zig-zag portions of the strand extending between the two respective rows, and bonding said zig-zag portions of the strand to the backing.

9. The method of making a multiple-hook fastener medium as claimed in claim 7, including the steps of:

softening material of the strand before said bending, and again softening material of the strand before said again bending.

10. The method of making a multiple-hook fastener medium as claimed in claim 9, in which:

said softening and said again softening are carried out by heating material of the strand, and said setting a first time and said setting a second time are carried out by cooling material of the strand.

11. The method of making a multiple-hook fastener medium for providing hook-like gripping engagement with an opposed area containing multiple accessible apertures into which the hooks can become engaged by bringing said fastener medium into contact with said opposed area comprising the steps of:

continuously moving multiple strands of shapable polymeric material lengthwise through a first shaping region, in said first shaping region shaping each strand into a corrugated configuration with a centerline in a plane and with sharp peaks and valleys located on opposite sides of the centerline, causing each of the shaped strands to retain said corrugated configuration, continuously moving said corrugated configured strands out of said first shaping region in the direction lengthwise relative to their respective centerlines, slowing the rate of travel in the direction lengthwise relative to their respective centerlines of the leading portions of said corrugated configured strands relative to the following portions thereof for closing the valleys of the corrugated configuration of each strand for forming left and right doubled-back shank portions of each strand projecting from opposite sides of the centerline, continuously moving said strands each having left and right doubled-back shank portions in a direction lengthwise relative to the respective centerlines into a second shaping region, in said second shaping region shaping the left and right doubled-back shank portions of each strand into left and right respective rows of hooks upstanding from the same side of the plane of the corrugated configuration and being located on opposite sides of the respective centerline with each strand extending back and forth across the respective centerline in a zig-zag manner between the respective successive left and right hooks for forming double rows of preformed interconnected hooks, causing each strand to retain its respective double rows of preformed interconnected hooks, continuously moving said strands each retaining their double rows of preformed interconnected hooks out of said second shaping region in a direction lengthwise of the respective centerlines, providing an area of backing material, extending the double rows of preformed interconnected hooks longitudinally relative to the respective centerlines along said backing material with the zig-zag portions of each strand adjacent to the backing material, and bonding said zig-zag portions to the backing material for forming the multiple-hook fastener medium.

12. The method of making a row of preformed double-legged interconnected hooks adapted to be fastened to a backing for forming a multiple-hook fastener medium, comprising the steps of:

moving a strand of bendable, polymeric material lengthwise into a first shaping zone and therein shaping the strand into a plurality of sharply doubled-back portions of the strand spaced along the strand, causing the strand to retain said sharply doubled-back portions of the strand, moving the strand containing said sharply doubled-back portions out of said first shaping zone, moving the strand with said sharply doubled-back portions into a second shaping zone and therein shaping the strand into a row of preformed double-legged interconnected hooks spaced along the strand with said sharply doubled-back portions forming tips of the respective hooks, moving the strand shaped into said preformed interconnected hooks from said second shaping zone into a setting zone and therein setting material of the strand to retain said preformed double-legged interconnected hooks, and moving the strand of preformed double-legged interconnected hooks out of said setting zone in readiness to be fastened to a backing.

13. The method of making hooks adapted to be fastened to a backing as claimed in claim 12, including the steps of:

softening material of the strand as it moves into said first shaping zone, and softening material of the strand as it moves into said second shaping zone.

14. The method of making hooks adapted to be fastened to a backing as claimed in claim 13, in which:

said softening of material of the strand is done by heating, and said setting of material of the strand is done by cooling.

15. A multiple-hook fastener medium made by the method of claim 1.

16. A multiple-hook fastener medium made by the method of claim 2.

17. A multiple-hook fastener medium made by the method of claim 1.

18. A mutliple-hook fastener medium made by the method of claim 4.

19. A multiple-hook fastener medium made by the method of claim 5.

20. A multiple-hook fastener medium made by the method of claim 6.

21. A multiple-hook fastener medium made by the method of claim 7.

22. A multiple-hook fastener medium made by the method of claim 8.

23. A multiple-hook fastener medium made by the method of claim 9.

24. A multiple-hook fastener medium made by the method of claim 10.

25. A multiple-hook fastener medium made by the method of claim 11.

26. A strand of bendable, settable material having interconnected hooks spaced along its length made by the method of claim 13.

27. A strand of bendable, settable material having interconnected hooks spaced along its length made by the method of claim 14.

28. A strand of bendable, settable material having interconnected hooks spaced along its length made by the method of claim 15.

29. A multiple-hook, fastener medium for providing hook-like gripping engagement with an opposed area containing multiple accessible apertures into which the hooks can become engaged by bringing said fastener medium into contact with said opposed area comprising:

an area of backing, a plurality of spaced parallel rows of multiple hooks mounted on said backing with said rows extending longitudinally along said backing, each row including a first plurality of identical spaced, aligned left hooks at spaced positions along the left lateral side of the row, each row including a second plurality of identical, spaced, aligned right hooks at spaced positions along the right lateral side of the row, all of the left and right hooks of said first and second pluralities of hooks in each row being formed from a respective continuous strand of bendable and settable polymeric plastic material, the respective strand extending back and forth in zig-zag manner between and interconnecting the respective successive left and right hooks of the row, and said zig-zag extending portions of the strand in each row being bonded to said area of backing for mounting the row of multiple hooks on said backing.

30. A multiple-hook fastener medium as claimed in claim 29, in which:

said area of backing contains material different from the polymeric plastic material in said strand.

31. A multiple-hook fastener medium as claimed in claim 29, in which:

said area of backing is woven.

32. A multiple-hook fastener medium as claimed in claim 31, in which:

a layer of metal foil is laminated to the lower side of said area of woven backing.

33. A multiple-hook fastener medium capable of hook-like gripping engagement comprising:

an area of backing, a plurality of hooks upstanding from said backing, each hook including a head portion with a tip and a shank portion, said hooks being in row and being bent from a single continuous strand of bendable material with the tip of each hook being a sharply bent portion of the continuous strand, and the shank portion of each hook including two segments of the continuous strand positioned near each other forming two legs, and said continuous strand being fastened to said backing between respective hooks.

34. A multiple-hook fastener medium as claimed in claim 33, in which:

the shank portion of each hook includes a pair of upwardly converging legs comprising two segments of the continuous strand.

35. The method of making a multiple-hook fastener medium capable of hook-like gripping engagement with an opposed area containing multiple accessible apertures into which the multiple hooks can become engaged by bringing said fastener medium into contact with said opposed area comprising the steps of:

bending at least one strand of a bendable, settable material for forming a plurality of spaced sharp U-bends, setting material of said strand a first time for causing the strand to retain said sharp U-bends, crossing respective portions of the strand near at least some of the respective sharp U-bends, again bending the strand near at least some of said sharp U-bends to form hooks with said sharp U-bends forming the tips of the hooks, when forming the respective hooks said bending of the strand being near the respective crossing portions for including said crossing portions in the respective hooks, setting material of said strand a second time for causing the strand to retain said hooks and during said second setting step, setting material of the strand for retaining said crossing portions in the respective hooks, and bonding the strand having said hooks and crossing portions to a backing with the hooks upstanding from the backing for forming the multiple-hook fastener medium.

36. A multiple-hook fastener medium capable of hook-like gripping engagement comprising:

an area of backing, a plurality of hooks upstanding from said backing, each hook including a head portion with a tip and a shank, said hooks being in a row and being bent from a single continuous strand of bendable material with the tip of each hook being a sharply U-bent portion of the continuous strand, the shank of each hook including crossed portions of the continuous strand, and said strand being fastened to said backing between respective hooks.

37. A multiple-hook fastener medium capable of hook-like gripping engagement comprising:

an area of backing, a plurality of hooks upstanding from said backing, each hook including a head portion with a tip and a shank portion, said hooks being in a row and being bent from a single continuous strand of bendable material with the tip of each hook being a sharply U-bent portion of the continuous strand, the heads of each hook including crossed portions of the continuous strand located near the U-bent tip, and said strand being fastened to said backing between respective hooks.

38. A multiple-hook fastener capable of hook-like gripping engagement with an opposed loop area comprising:

an area of backing, at least one double row of hooks mounted on said backing, said double row of hooks having a centerline with a plurality of hooks located at spaced positions along the left side of said centerline and a plurality of hooks located at spaced positions along the right side of said centerline, said hooks along the left side of the centerline and said hooks along the right side of the centerline in said double row all being formed from the same continuous strand, each hook including a shank portion extending up from the backing with a bent over head portion at the top of said shank portion, the shank portion and head portion of each hook comprising two closely spaced segments of the continuous strand forming two legs for each hook, respective hooks on the left side of said centerline being interconnected with hooks on the right side of said centerline by segments of the continuous strand which extend across the centerline, and said double row of hooks being mounted on said backing by mounting to the backing said segments of the continuous strand which extend across the centerline.

39. A multiple-hook fastener as claimed in claim 38, in which:

the two legs of each hook converge toward each other in the direction upwardly from the backing.

40. A multiple-hook fastener as claimed in claim 38, wherein:

there are a plurality of such double row of hooks mounted on said backing, each such double row of hooks being formed from a respective continuous strand, and the respective continuous strands are of different predetermined colors.

41. A multiple hook fastener as claimed in claim 38, in which:

said segments of the continuous strand extend in zigzag configuration across said centerline.

42. An elongated shape-retaining strand bent into an elongated double row of hooks having a centerline, said double row of hooks comprising:

hooks located at spaced positions along the left side of said centerline and hooks located at spaced positions along the right side of said centerline, each hook including an upstanding shank portion and a bent-over head portion located at the upper end of said shank portion, the shank portion and the head portion of each hook comprising two closely spaced segments of said elongated strand providing two lets for supporting the head portion of each hook, and said elongated strand extending back and forth across said centerline, a portion of said strand extending from the foot end of one of the legs of a first hook on the left side of the line to the foot end of one of the legs of a second hook on the right side of the line and another portion of said strand extending from the foot end of the other leg of said second hook to the foot end of a leg of a third hook on the left side of the line and another portion of said strand extending from the foot end of the other leg of said third hook to the foot end of a leg of a fourth hook on the right side of the line, and so forth along said double row of hooks.

* * * * *